United States Patent [19]

Pryor

[11] 4,431,206

[45] Feb. 14, 1984

[54] WHEELCHAIR MEDICAL ACCESSORY CARRIER

[76] Inventor: John W. Pryor, 420 N. Cedros, Solana Beach, Calif. 92075

[21] Appl. No.: 287,264

[22] Filed: Jul. 27, 1981

[51] Int. Cl.[3] ..... A47C 7/62

[52] U.S. Cl. ..... 280/289 WC; 297/191; 297/DIG. 4

[58] Field of Search ..... 280/289 WC, 202, 289 A, 280/289 R; 247/DIG. 4, 188, 191; 403/362, 261

[56] References Cited

U.S. PATENT DOCUMENTS

| | | | |
|---|---|---|---|
| 2,951,720 | 7/1960 | Folz | 403/362 |
| 3,709,556 | 1/1973 | Allard et al. | 297/188 |
| 3,970,344 | 7/1976 | Baumann | 297/DIG. 4 |
| 3,971,591 | 7/1976 | Ziaylek | 297/191 |
| 4,045,044 | 8/1977 | Bierer | 297/188 |
| 4,251,165 | 2/1981 | Forsen | 403/362 |

FOREIGN PATENT DOCUMENTS

| | | | |
|---|---|---|---|
| 1287297 | 8/1972 | United Kingdom | 297/DIG. 4 |

OTHER PUBLICATIONS

Brochure: Oxygen Cylinder Brackets from Continental Goods Co., Inc., Effective Date Aug. 1, 1974, 6 pages.
Leaflet: ADC IV Support Systems from ADC Hospital Equipment Div. of Automatic Devices Co., 2 pages.
Wheel Chair Cylinder Holder, *Rx Home Care Magazine,* Jun.-Jul. 1981, p. 73.

*Primary Examiner*—Joseph F. Peters, Jr.
*Assistant Examiner*—Donn McGiehan
*Attorney, Agent, or Firm*—Brown & Martin

[57] ABSTRACT

An accessory carrier for carrying oxygen bottles, intraveneous containers and other medical accessories includes a lower vertically extending post for detachable attachment to the back of a wheelchair in a position to permit folding of the chair and including an upper elongated vertically extending post detachably connectable to the first post for supporting additional accessories. The lower post includes a slip bracket at the lower end thereof for attachment to a trailing kick tube of a wheelchair and includes a clamp sleeve for retaining the slip bracket in place on the tube. The tube clamp and the upper post may include either a thumb screw for holding it in place or a screw requiring a special tool, such as an Allen Wrench, to discourage theft.

8 Claims, 5 Drawing Figures

WHEELCHAIR MEDICAL ACCESSORY CARRIER

BACKGROUND OF THE INVENTION

Many wheelchair patients require the use of oxygen and other medical supplements such as intraveneous feeding and the like. Such accessories are typically supported on a mobile stand for movement about a hospital and other areas with the patient.

Prior attemps to mount such accessories on wheelchairs have been unsuccessful. The prior attempts have failed to provide an accessory carrier that enables a wheelchair to be conveniently utilized in the usualy manner as well as folded for transport in automobiles and the like.

It is desirable that improved accessory carriers be available for mounting on wheelchairs for carrying medical accessories and the like without interference with normal use of the wheelchair.

SUMMARY AND OBJECTS OF THE INVENTION

It is the primary object of the present invention to provide an improved medical accessory carrier for mounting on a wheelchair.

In accordance with the primary aspect of the present invention, a medical accessory carrier for mounting on a wheelchair includes a vertical lower post and a detachable upper post with the lower post detachably mounted to the wheelchair with means clamping the lower post to the frame of the wheelchair to permit normal operation of the wheelchair. Another aspect of the invention is the use of retaining screws requiring special tools that discourage theft.

BRIEF DESCRIPTION OF THE DRAWING

The above and other objects and advantages of the invention will become apparent from the following description when read in conjunction with the drawings, wherein.

DETAILED DESCRIPTION OF PREFERRED EMBODIMENTS

Figure 1:
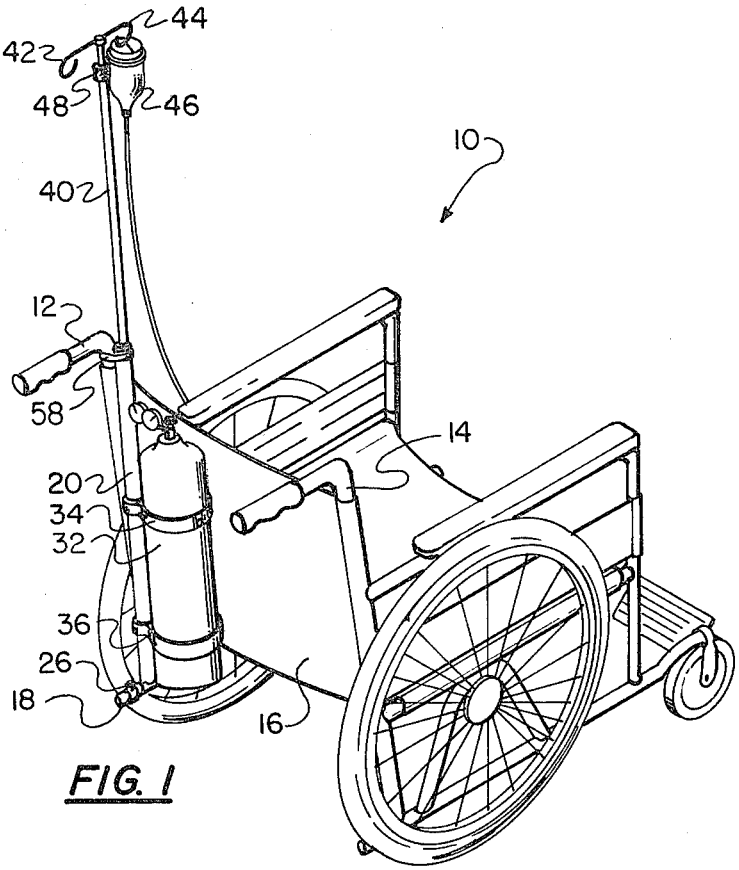
FIG. 1 is a perspective view of a typical wheelchair with the invention installed.

Turning to the drawings there is illustrated in FIG. 1 a typical wheelchair of the folding type having large rear wheels with a canvas seat and back suspended between tubular frame sections. In the usual construction the wheelchair is capable of folding with the frame folding to allow the entire wheelchair assembly to lay flat. The seat and back are typically of a fabric material that let the two sides come together to provide a relatively compact arrangement.

The wheelchair designated generally by the numeral 10 includes a frame assembly which includes a pair of vertical back support tubes 12 and 14 between which the canvas back 16 is mounted.

A carrier assembly in accordance with the invention is detachably mounted on the vertical tube 12 and a horizontally extending backwardly extending kick tube

18. The carrier assembly comprises a lower vertically extending tubular post member 20 having a tubular slide bracket 22 secured such as by welding to the lower end thereof and extending outward at an angle of approximately 90 degrees to the axis of the tubular member 20 for mounting on a back tube 18 of the wheelchair.

Figure 5:
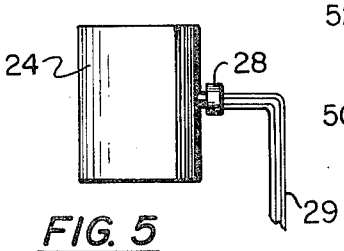
FIG. 5 is a top plan view of an alternate tube clamp.
Figure 3:
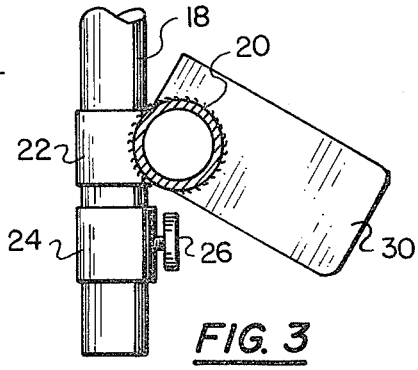
FIG. 3 is a section view taken generally on line 3—3 of FIG. 2.

A tubular retaining clamp 24 retains the slide bracket 22 on the tube 18. The clamp 24 may include a thumb screw 26 for easy attachment and mounting of the carrier assembly or it may include, as illustrated in FIG. 5, a set screw 28 requiring a special wrench, such as an Allen Wrench, for attachment of the clamp to the tube 18. The use of an Allen Wrench, for example, prevents a great deal of theft in that such frequently occurs only on an opportunity basis and an Allen Wrench is in the nature of a key and not a tool typically carried in the pocket of an individual.

The carrier assembly includes a tab or support bracket 30 welded to and extending outward at an angle of about 90 degrees from the axis of post 20 on which an oxygen bottle 32 rests. The tab 30 extends out at an angle of about 45 degrees from the axis of the sleeve or slip bracket 22. The oxygen bottle rests on this tab 30 and is held in place by means of upper and lower straps 34 and 36, with the upper strap or clamp 34 including a thumb or hand screw 38 for clamping the bottle in position. This position of the oxygen bottle permits the chair to fold in the usual manner with very little interference from the bottle.

The carrier assembly includes an upper elongated tubular post 40 that includes a pair of arms 42 and 44 for supporting such items as an intraveneous bottle 46 and the like. The upper post 40 is detachably secured to the upper end of the lower post 20 and may be vertically adjustable within certain limits and may further include means such as a clamp 48 for detachably securing alternate brackets to the upper end thereof.

Figure 4:
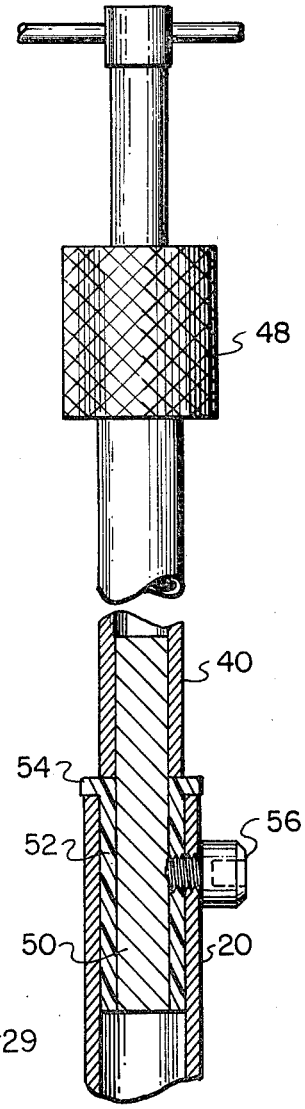
FIG. 4 is a partial view partially in section showing details of connecting joints.
Figure 2:
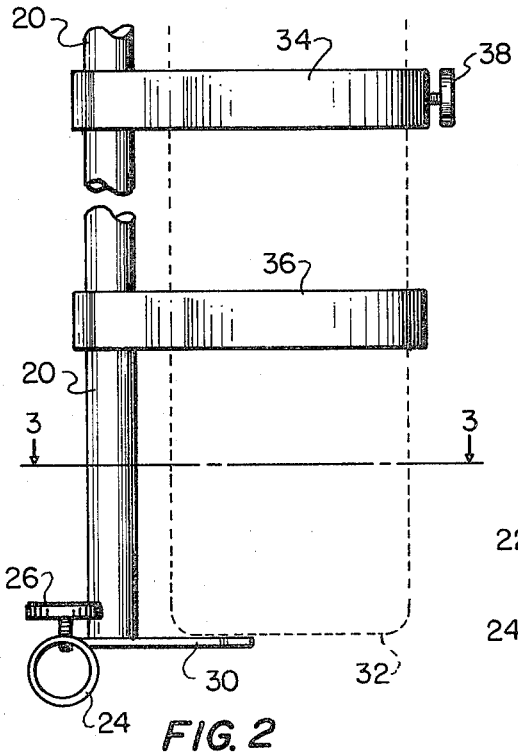
FIG. 2 is a side elevational view showing enlarged portions of the carrier.

Turning to FIG. 4, details of the detachable connection between the upper post 40 and the lower post 20 are illustrated. As illustrated in FIG. 4 the upper post 40 is preferably a light weight high strength tubular member which includes a cylindrical pin 50 secured in and extending from the lower end thereof for telescopically inserting into the upper end of the post 20. The upper end of the post 20 is provided with a tubular sleeve 52 extending downward for a length into the upper end of the post 20 for accommodating the cylindrical pin 50.

The sleeve 52 preferably has a radial flange 54 at the upper end to rest on the upper end of the lower post 20 and cushion the connection therein. This sleeve is preferably constructed of a hard rubber-like material such as a suitable plastic or the like. A set screw 56 is threaded into a bore in the upper end of post 20 and extends through the sleeve into engagement with the pin 50 for retaining it in position. Preferably this screw 56 has a head that requires a special tool such as an Allen Wrench or the like. This screw 56 essentially becomes a key operated lock screw. This arrangement, as previously explained with regard to the lower bracket, discourages the spontaneous opportunity type of theft because the upper post 40 cannot be readily removed from the wheelchair. A typical total length for the post assembly is about 99 inches. This will not fit into the average automobile. Therefore, the wheelchair with the upper post 40 in place cannot be placed in the typical automobile and, thus cannot be readily removed without the use of a special tool.

The upper end of the lower post 20 is detachably secured to the vertical back support tube 12 by a suitable strap or clamp 58. However, I prefer a friction lock type flexible strap made of a tough durable plastic material which has sufficiently flexibility to allow the wheelchair to fold with the carrier in place.

Thus while I have illustrated and described my invention by means of specific embodiments, it is to be understood that numerous changes and modifications may be made therein without departing from the spirit and scope of the invention as defined in the appended claims.

Having described my invention, I now claim:

1. A medical accessory carrier for a wheelchair, said carrier comprising:

an elongated lower post for detachably mounting in a vertical position to the back support tube of a wheelchair, said post including a tubular slip bracket at the lower end thereof extending at approximately 90 degrees to the axis of said lower post for extending over and mounting on the backward extending kick tube of a wheelchair, a sleeve clamp for mounting on the kick tube of a wheelchair outward of said slip bracket for retaining said slip bracket in position on said kick tube, a bottle support tab secured to and extending outward at an angle of about 45 degrees from said tubular slip bracket from the lower end of said lower post for supporting an oxygen bottle, and clamp means disposed along said lower post for detachably clamping an oxygen bottle in a vertical position to said lower post.

2. The medical accessory carrier of claim 1 wherein said sleeve clamp includes a key operated lock screw for locking said clamp in position on said kick tube.

3. The medical accessory carrier of claim 2 wherein said key operated lock screw is an Allen screw.

4. The medical accessory carrier of claim 1 including an elongated upper post detachably secured coaxially to and extending upward from the upper end of said lower post.

5. The medical accessory carrier of claim 4 including key operated lock screw means for locking said elongated upper post to said lower post.

6. The medical accessory carrier of claim 5 wherein said lower post includes a substantially rigid sleeve in the upper end thereof, and said upper post includes a cylindrical pin telescopically received in said substantially rigid sleeve and said locking screw extends into and engages said cylindrical pin.

7. A medical accessory carrier for a wheelchair, said carrier comprising:

an elongated lower post for detachably mounting in a vertical position to the back support tube of a wheelchair, said lower post including a tubular slip bracket secured to the lower end thereof and having an axis extending at right angles to the axis of said lower post for extending over and mounting on the backward extending kick tube of a wheelchair, a bottle support tab secured to and extending outward at an angle of about 45 degrees to the axis of said tubular slip bracket from the lower end of said lower post for supporting an oxygen bottle, a sleeve clamp having key operated lockable screw means for mounting on the backward extending kick tube of a wheelchair and lockably holding said slip bracket in position thereon, an elongated upper post detachably secured coaxially to and extending upward from the upper end of said lower post, and key operated locking screw means on the upper end of said lower post for lockably engaging and locking said elongated upper post to said lower post.

8. The medical accessory carrier of claim 7 wherein said key operated screw means is an Allen screw.

* * * * *